US008701719B2

(12) United States Patent
Clüsserath

(10) Patent No.: US 8,701,719 B2
(45) Date of Patent: Apr. 22, 2014

(54) METHOD OF FILLING BOTTLES OR SIMILAR CONTAINERS IN A BOTTLE OR CONTAINER FILLING PLANT AND A FILLING SYSTEM FOR FILLING BOTTLES OR SIMILAR CONTAINERS IN A BOTTLE OR CONTAINER FILLING PLANT

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 1006 days.

(21) Appl. No.: 12/650,083

(22) Filed: Dec. 30, 2009

(65) Prior Publication Data

US 2010/0192521 A1 Aug. 5, 2010

Related U.S. Application Data

(63) Continuation-in-part of application No. PCT/EP2008/004882, filed on Jun. 18, 2008.

(30) Foreign Application Priority Data

Jun. 30, 2007 (DE) ..... 10 2007 030 559

(51) Int. Cl.
*B65B 3/30* (2006.01)
*B65B 3/34* (2006.01)

(52) U.S. Cl.
USPC ..... 141/9; 141/95; 141/145; 141/186; 141/244; 53/503; 53/281

(58) Field of Classification Search
USPC ..... 141/1, 9, 94–95, 104, 144–145, 186, 141/196, 237, 242, 244; 53/281, 473, 503
See application file for complete search history.

(56) References Cited

U.S. PATENT DOCUMENTS 2,775,269 A * 12/1956 Breeback ..... 141/99
4,053,003 A * 10/1977 Ferrero et al. ..... 141/144

(Continued)

FOREIGN PATENT DOCUMENTS

GB 2 288 168 A 10/1995
JP H06135493 5/1994

OTHER PUBLICATIONS

International Search Report PCT/EP2008/004882 and English translation thereof.

*Primary Examiner* — Gregory Huson
*Assistant Examiner* — Nicolas A Arnett
(74) *Attorney, Agent, or Firm* — Nils H. Ljungman & Associates

(57) ABSTRACT

A method for filling containers with liquid. Liquid is provided from a reservoir and at least two filling positions, of a filling position group, are each configured to fill a container with liquid at a filling rate. With a common flow meter, a total volume of liquid flowing into the containers at the filling positions of the filling position group is measured during a filling phase. A liquid control valve of each of the filling positions is opened and closed in response to: a measurement signal provided by the flow meter; and at least one of (a) and (b) where: (a) is a time correction compensating for filling rates being different for the filling positions; and (b) is at least one throttle influencing the filling rates. The containers at the filling positions are filled such that each of the containers contains a required volume of liquid at the end of the filling phase.

20 Claims, 2 Drawing Sheets

(56) References Cited

U.S. PATENT DOCUMENTS

| | | | | |
|---|---|---|---|---|
| 4,467,847 | A * | 8/1984 | Zodrow | 141/98 |
| 5,417,260 | A * | 5/1995 | Perrier | 141/146 |
| 6,148,877 | A * | 11/2000 | Bethke | 141/103 |
| 6,378,575 | B1 | 4/2002 | Marchau | |
| 6,530,402 | B2 | 3/2003 | Suzuki et al. | |
| 7,409,971 | B2 * | 8/2008 | Bonatti et al. | 141/9 |
| 7,469,726 | B2 * | 12/2008 | Clusserath et al. | 141/57 |
| 7,866,123 | B2 * | 1/2011 | Clusserath | 141/144 |
| 2003/0010398 | A1 * | 1/2003 | Tanaka et al. | 141/94 |
| 2005/0045244 | A1 * | 3/2005 | Hartness et al. | 141/144 |
| 2005/0241726 | A1 * | 11/2005 | Clusserath et al. | 141/144 |
| 2010/0000182 | A1 * | 1/2010 | Clusserath | 53/284.5 |
| 2010/0307638 | A1 * | 12/2010 | Poeschel et al. | 141/94 |
| 2011/0071660 | A1 * | 3/2011 | Fu | 700/104 |
| 2012/0018030 | A1 * | 1/2012 | Laumer et al. | 141/1 |

* cited by examiner

METHOD OF FILLING BOTTLES OR SIMILAR CONTAINERS IN A BOTTLE OR CONTAINER FILLING PLANT AND A FILLING SYSTEM FOR FILLING BOTTLES OR SIMILAR CONTAINERS IN A BOTTLE OR CONTAINER FILLING PLANT

CONTINUING APPLICATION DATA

This application is a Continuation-In-Part application of International Patent Application No. PCT/EP2008/004882, filed on Jun. 18, 2008, which claims priority from Federal Republic of Germany Patent Application No. 10 2007 030 559.3, filed on Jun. 30, 2007. International Patent Application No. PCT/EP2008/004882 was pending as of the filing date of this application. The United States was an elected state in International Patent Application No. PCT/EP2008/004882.

BACKGROUND

1. Technical Field

The present application relates to a method of filling bottles or similar containers in a bottle or container filling plant and a filling system for filling bottles or similar containers in a bottle or container filling plant.

2. Background Information

Background information is for informational purposes only and does not necessarily admit that subsequently mentioned information and publications are prior art. Methods and filling systems for the filling of bottles or similar containers with a liquid are known in a wide variety of different realizations.

There are some existing filling systems and filling machines that employ a rotary construction for the filling of bottles on the basis of the quantity or volume of the liquid being bottled, or the filling of such containers with a plurality of filling elements on a rotor that is drive in rotation around a vertical machine axis. Each filling element is associated with its own flowmeter, such as a magnetic-inductive flowmeter (MIF), for example, which, during the filling phase, i.e. after the opening of a liquid control valve which is provided in the respective filling element, measures the quantity of liquid flowing to the container in question and transmits a corresponding measurement signal, continuously, usually continuously, or substantially continuously, to a control unit which, when the desired quantity of liquid in the container is reached, effects the closing of the liquid control valve and thus the termination of the filling phase.

OBJECT OR OBJECTS

An object of at least one possible embodiment of the present application is a method which makes possible a filling of bottles or similar containers which is controlled as a function of the volume or quantity of liquid using simplified means at a simultaneously reduced cost.

SUMMARY

To accomplish this object, at least one possible embodiment of the present application teaches a method for filling bottles or similar containers with a liquid, from a reservoir or bowl that provides the liquid to be bottled, using filling positions, each of which has a control valve or liquid control valve, wherein for at least two filling positions that form a filling position group the total quantity of liquid flowing into the containers provided in these filling positions is measured with a flowmeter, and that the liquid control valves are opened and/or closed in a staggered manner taking into consideration the measurement signal supplied by the flowmeter and a time correction that compensates for different filling rates of the filling positions, so that each container contains the required quantity of liquid following the completion of the filling phase. To further accomplish this object, at least one possible embodiment of the present application teaches a filling system for filling bottles or similar containers with a liquid, from a reservoir or bowl that provides the liquid to be bottled, with control valves or liquid control valves and filling elements, the filling quantity of which is controlled by a control device, wherein the filling elements form at least one filling element group with at least two filling elements, that each filling element group is associated with a flowmeter for the measurement of the total quantity of liquid which is discharged in each filling phase via the filling elements of this filling element group, and that the control device of the liquid control valves opens and/or closes the liquid control valves in a staggered manner, taking into consideration the measurement signal supplied by the respective flowmeter and a time correction that compensates for the different flow rates of the filling elements, and/or the at least one adjustable throttle is influenced so that each container contains the required quantity of liquid after the completion of the filling phase.

At least one possible embodiment of the present application teaches that in each filling phase, at least two bottles or containers are filled simultaneously or approximately simultaneously in at least two filling positions associated with a common flowmeter and thereby differences in the filling rate of the filling positions can be compensated by a time correction, for example by the chronologically staggered opening and/or closing of the filling positions and/or of the liquid control valves of these filling positions. Differences in the filling rates can have a variety of causes.

Especially in filling systems or filling machines in which the filling of the containers occurs essentially as a result of the effects of the geodetic pressure of the liquid being bottled, i.e. utilizing the difference in height between the surface of the liquid in a reservoir or bowl in which the liquid is prepared and the level of the individual filling position, such differences in the filling rate can be caused, for example, by different flow resistances in the liquid lines or connections leading to the filling positions and/or in particular by different heights of the filling positions.

Also affected, however, are also certain open-jet filling methods, e.g. for the bottling of syrup, in which the bowl is also placed under a slight overpressure to accelerate the discharge of the liquid to be bottled.

In at least one possible embodiment of the present application, the filling positions or filling elements that are associated with a common group of filling positions or a common flow meter are located on different vertical levels, i.e. they are separated from one another in the vertical direction. This arrangement makes it possible, in particular on filling machines that employ a rotary construction, to increase the number of filling positions or filling elements that are provided on the periphery of a rotor that is driven in rotation around a vertical machine axis, i.e. to double the number, for example, without the need or substantial need to increase the diameter of the rotor.

Developments, advantages and potential applications of at least one possible embodiment of the present application are described below with reference to exemplary or possible embodiments and the accompanying figures. All or substantially all of the features described and/or illustrated either individually or in any desired combination are within the basic teaching of at least one possible embodiment of the present application, regardless of their placement in the present application.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

The invention is described in greater detail below with reference to the accompanying figure which illustrates a filling system claimed by the invention.

DESCRIPTION OF EMBODIMENT OR EMBODIMENTS

Figure 1:
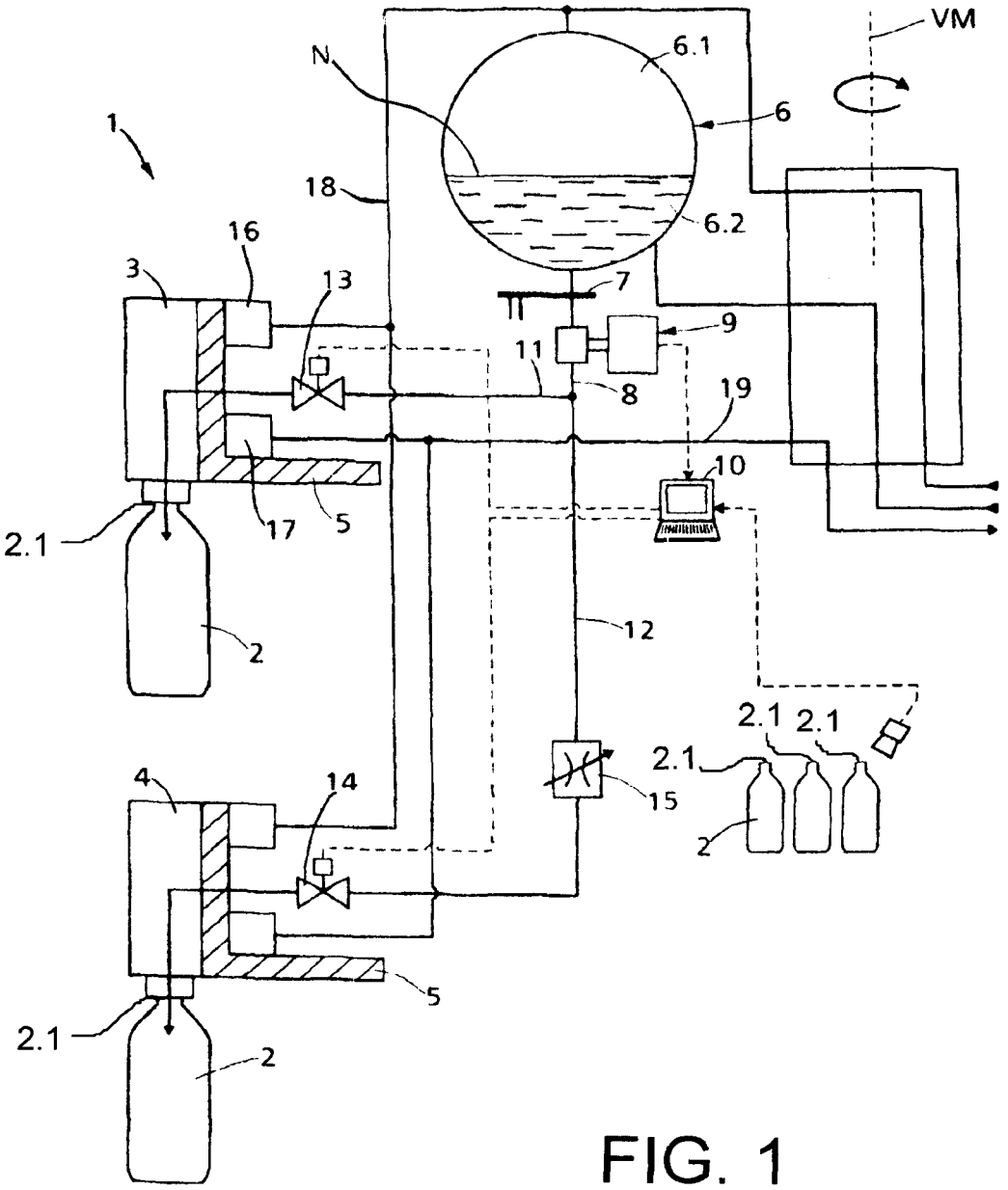
FIG. 1 shows one possible embodiment of a filling system according to the present application.

The filling system which is designated 1 in general in the figure is a component of a filling machine that employs a rotary construction for the filling of bottles 2 with a liquid. In the illustrated exemplary embodiment, the filling system 1 consists or substantially consists of two filling elements 3 and 4 which are provided on different vertical levels, i.e. they are offset from each other in the vertical direction or are provided one above the other on a rotor 5 which is driven in rotation around a vertical machine axis, and specifically so that the filling element 3 is on a higher level than the filling element 4.

Associated with each filling element 3 and 4 is a bottle or container carrier (not shown), which for the filling process holds the individual bottle 2, which is oriented with its bottle axis in the vertical or substantially vertical direction, with its bottle mouth 2.1 in contact with the corresponding filling element 3 or 4, and specifically in sealed contact, and/or for an open-jet filling at some distance from the filling element or the filling element discharge opening. On the periphery of the rotor 5 there are a plurality of filling element pairs, each consisting of a filling element 3 and a filling element 4, plus the corresponding container or bottle carriers. The filling machine is realized so that when the rotor 5 is in rotation, the bottles 2 are delivered to the respective bottle or container carriers and the filled bottles 2 are removed at a container outlet from the rotor 5 or from the container carriers located at the container outlet.

For the preparation of the liquid a bowl 6 is provided on the rotor 5, whereby the level in the bowl 6 is filled in a controlled manner at least during the filling process up to the level N with the liquid to be bottled, and specifically so that a headspace 6.1 is created in the bowl above the surface of the liquid and a liquid space 6.2 is created below the surface of the liquid. The bowl 6 is also realized so that it or its bottom is located significantly higher than the discharge openings of the upper filling element 3. By means of a distributor 7 that emerges in the bottom of the bowl 6, the filling element pairs or groups, each of which is formed by a filling element 3 and a filling element 4, are connected by means of an individual line 8, in which a flowmeter 9, such as a magnetically inductive flowmeter, for example, is provided in common for the two filling elements 3 and 4 of each filling element pair. During the filling of the bottles 2 of the filling element pair in question, said flowmeter 9 carries the flow of the liquid being discharged from the bowl 6 and transmits a measurement signal corresponding to the total quantity filled by both filling elements 3 and 4 to a central control unit 10 of the filling machine, such as a computer, for example.

In at least one possible embodiment of the present application, a group of filling elements, grouped together by the use of a single or sole flow meter 9, may comprise the filling elements 3 and 4, which are disposed one above the other on the circumference of the rotor 5 of the filling system 1. In other embodiments of the present application, the group of filling elements may comprise a different number of filling elements. For example, the group may comprise two filling elements disposed at a first height on the rotor 5 and two filling elements disposed at a second height, being lower than the first height, on the rotor 5. Also, the group may possibly comprise two filling elements disposed at the first height and one filling element disposed at the second height. In another possible embodiment, the group may comprise one filling element disposed at the first height and two filling elements at the second height. In further embodiments of the present application, the group may comprise additional combinations and numbers of filling elements disposed at various heights along the circumference of the rotor 5. Groups of filling elements may alternate along the circumference of the rotor 5 of the filling system 1. For example, a first group may comprise two filling elements at the first height and one filling element at the second height. A second group, disposed adjacent the first group, may comprise one filling element at the first height and two filling elements at the second height.

In at least one possible embodiment of the present application, groups of filling elements may also comprise filling elements in a location on the circumference of the rotor 5 where there may be a substantial difference in flow rates and/or filling rates. For example, the filling system 1 may comprise two concentric paths for beverage bottles or containers. The two concentric paths may have the same height on the rotor. The two concentric paths have comprise different radii, so the first concentric path is inner and the second concentric path is outer, with respect to the rotational axis. In another possible embodiment, the grouping of filling elements by use of a common flow meter 9 may also be utilized in a nonconcentric filling system.

In the direction of flow downstream of the flowmeter 9, each line 8 branches into lines 11 and 12, of which the line 11 connects the filling element 3 and the line 12 connects the filling element 4 with the output of the flowmeter 9. In each line 11 and 12 respectively there is a control or liquid control valve 13 (in the line 11) or 14 (in the line 12). The control or liquid control valves 13 and 14, which can be, for example, the conventional liquid control valves of the filling elements 3 and 4, can be controlled individually, and specifically by the control device 10. At least one adjustable throttle 15 is also provided in the line 12.

The filling system 1 or the filling machine is basically controlled so that, after the positioning of a bottle 2 at the filling element 3 and the filling element 4, the filling phase is initiated simultaneously at both filling elements, and specifically by the simultaneous opening of the liquid valves 13 and 14. The total quantity of liquid that then flows to the two bottles 2 of the filling element group is measured with the flowmeter 9, and a corresponding measurement signal is continuously transmitted to the control device 10. The filling rate, i.e. the rate at which the liquid flows into the respective bottle 2 when the liquid control valves 13 and 14 are opened, is a function of, among other things, the difference in height between the level N of the liquid in the bowl 6 and the level of the filling element discharge opening of the filling element 3 or 4. Because the filling element 4 is located below the filling element 3, the filling rate of this filling element is basically higher than the filling rate at the filling element 3.

Upon the completion of the filling process, the liquid control valve 14 is closed by a corresponding control program stored in the control device 10 before the closing of the liquid control valve 13, so that as a result of this time correction, after the ending of the filling phase, the total quantity of liquid measured by the flowmeter 9 is distributed to both bottles 2, i.e. both bottles contain the required or desired quantity of liquid after the completion of the filling phase.

The delay in the closing of the liquid control valve 13 is determined, for example, by a test run, and specifically, for example, so that the time required or desired for the filling of the correct volume into the bottles 2 on the filling element 4 is determined and is stored as the shutoff time for the liquid control valve 14 in the memory of the control device 10, and that then, taking this shutoff time into consideration and the measurement signal corresponding to the total volume supplied by the flowmeter 9, the liquid control valve 13 is then closed when the measured total volume equals a specified value. Of course, other control methods for the liquid control valves 13 and 14 of the respective filling system 1 can also be used.

With the throttle 15 provided in the line 12, the flow and filling rate at the lower filling element 4 can be set so that it is equal to or at least approximately equal to the flow or filling rate at the filling element 3, so that a simultaneous or approximately simultaneous closing of the liquid control valves 13 and 14 is possible.

To make it possible to use different filling methods, the filling element 3 and 4 are also realized with the conventional, controlled gas paths which are in communication with ring ducts 16 and 17 provided on the rotor 5 and are common to all or essentially all of the filling elements 3 and 4 of the filling machine, and are in communication via a line 18 with the gas space 6.1 of the bowl (ring duct 16) or via a line 19 (ring duct 17) with the atmosphere and/or with a vacuum or underpressure source.

One essential or substantially essential advantage of the filling system 1 or of a corresponding filling machine consists or substantially consists of a significant reduction of the required or desired number of flowmeters 9, i.e. in the exemplary embodiment described above with two filling elements 3 and 4 per group of filling elements and flowmeters 9, the number of flowmeters can be reduced by 50% compared to conventional filling systems or filling machines, which contributes to a significant reduction of the total costs of a filling machine.

At least one possible embodiment of the present application was described above on the basis of one exemplary embodiment. It goes without saying that numerous modifications and variations can be made without thereby going beyond the teaching of at least one possible embodiment of the present application.

For example, it was assumed above that the time correction that compensates for the different flow and filling rates is made at the time of the closing of the liquid control valves 13 and 14 at the end of the respective filling phase. Instead of or in addition to that method however, it is also possible to make a corresponding time correction at the beginning of the respective filling phase or of the joint filling of two bottles at the filling elements 3 and 4, and specifically so that the liquid control valve 13 is opened before the liquid control valve 14.

It is also possible to realize at least one of the two bottle or container carriers of the filling element group, for example the container carrier associated with the filling element 3, with a weighing device or with a corresponding sensor to constantly or virtually constantly determine the quantity of liquid flowing into the bottle 2 in question by weighing, and to make a corresponding measurement signal available to the control device 10, from which, taking into consideration the measurement signal from the flowmeter 9, the liquid control valves 13 and 14 can then be controlled for a volume-controlled filling of the bottles 2 on the two filling elements 3 and 4.

An additional potential manner of compensating for irregularities in the filling times and filling quantities also consists or substantially comprises providing means such as sensors or cameras, for example, with image processing systems at the outlet of the filling machine which measure the fill height and/or the fill quantity of the bottles 2 filled using one and the same flowmeter 9 and comparing them with each other. Differences determined during this process can then be compensated by turning on the time correction feature for the closing of the liquid control valves 13 and 14 in the subsequent filling phases.

In other words, and in at least one possible embodiment of the present application, in subsequent filling operations, the control device 10 may monitor the filling system 1 as beverage bottles or containers 2 are being filled. If any differences in the flow of the beverage through the lines 8, 11, and 12 or the time desired to fill a bottle 2 are sensed by the control device 10 and/or any sensors of the filling system 1, the control device 10 may then adjust the staggered opening and/or closing of the valves 13 and 14 in future bottle runs.

In an additional configuration of at least one possible embodiment of the present application, the differences can also be compensated by an influencing of the at least one adjustable throttle 15 effected by the means.

In at least one possible embodiment of the present application, the filling phases of the filling elements 3 and 4 may be determined by trial and error. For example, both liquid control valves 13 and 14 are opened at the same time and filling of the bottles or containers 2 at the filling elements 3 and 4 are begins simultaneously or substantially simultaneously. The common flow meter 9 measures the quantity of liquid beverage material flowing from the reservoir 6 to. Once the bottom bottle 2 is filled at the bottom filling element 4, the control valve 14 is closed. The filling phase of the filling element 4 is recorded. The top bottle 2 may continue to fill after the bottom bottle 2 is filled. Once the top bottle 2 is filled at the top filling element 3, the control valve 13 is closed. The filling phase of the filling element 3 is recorded. The control device 10 may then be programmed with the times for future runs of filling bottles.

In other words, the filling times of bottles and containers 2 may be determined by experimentation. The control valves 13 and 14 may be turned opened and/or closed in a staggered manner until sufficient data is collected about the filling phases of the filling elements 3 and 4. With this sufficient data, the control device 10 may be programmed to control the filling system 1 and the filling phases of the filling elements 3 and 4.

In another possible embodiment of the present application, the filling phases of the filling elements 3 and 4 may be calculated and determined without experimentation. By taking into account the height of the reservoir 6 in relation to the discharge openings of the filling elements 3 and 4, the filling rate of the filling element 3 and the filling rate of the filling element 4, and the measurement of the flow meter 9, the filling phases and filling times of the filling elements 3 and 4 may be determined before the bottles 2 are filled. The control device 10 may be programmed to control the valves 13 and 14 to sufficiently fill bottles and containers 2 at the filling elements 3 and 4.

Figure 2:
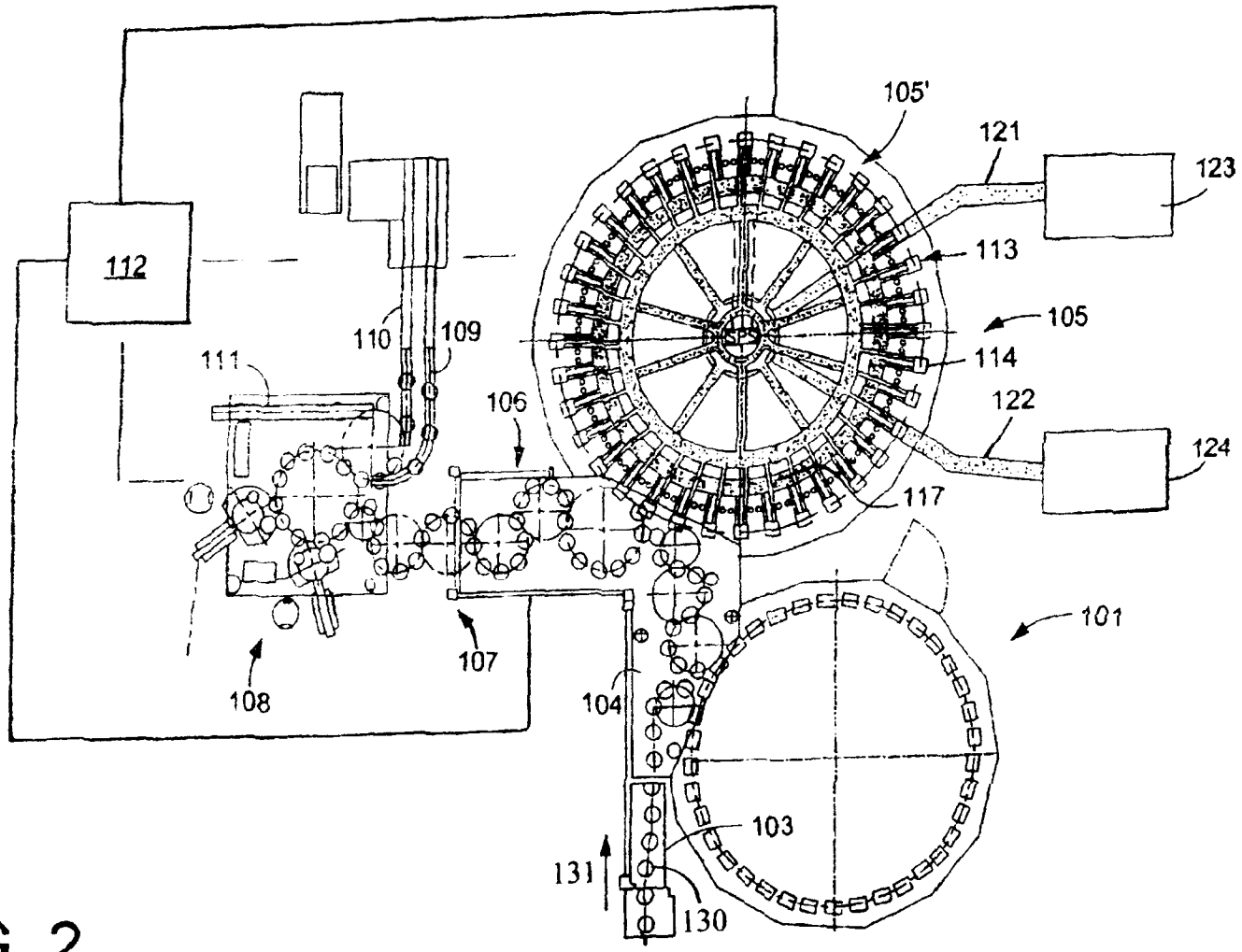
FIG. 2 shows schematically the main components of one possible embodiment example of a system for filling containers, in one possible embodiment a beverage bottling plant for filling bottles with at least one liquid beverage, in accordance with at least one possible embodiment, in which system or plant could possibly be utilized at least one aspect, or several aspects, of the embodiments disclosed herein.

FIG. 2 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 2 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 2, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

At least one possible embodiment of the present application relates to a method for the filling of bottles or similar containers with a liquid from a reservoir or bowl that supplies the liquid being bottled, using filling positions that each have a control valve or liquid control valve and are controlled on the basis of the quantity filled into the bottle.

At least one possible embodiment relates to a method for filling bottles or similar containers 2 with a liquid, from a reservoir or bowl 6 that provides the liquid to be bottled, using filling positions 3, 4, each of which has a control valve or liquid control valve 13, 14, characterized in that for at least two filling positions 3, 4 that form a filling position group the total quantity of liquid flowing into the containers 2 provided in these filling positions is measured with a flowmeter 9, and that the liquid control valves 13, 14 are opened and/or closed in a staggered manner taking into consideration the measurement signal supplied by the flowmeter 9 and a time correction that compensates for different filling rates of the filling positions 3, 4, so that each container 2 contains the required or desired quantity of liquid following the completion of the filling phase, and a method for filling bottles or similar containers 2 with a liquid, from a reservoir or bowl 6 that provides the liquid to be bottled, using filling positions 3, 4, each of which has a control valve or liquid control valve 13, 14, wherein for at least two filling positions 3, 4 that form a filling position group, the total quantity of liquid flowing into the containers 2 provided in these filling positions is measured with a flowmeter 9, and that the at least one adjustable throttle 15 is influenced, taking into consideration the measurement signal supplied by the flowmeter 9, so that each container 2 contains the required or desired quantity of liquid following the completion of the filling phase, whereby the liquid control valves 13, 14 are opened and/or closed simultaneously or approximately simultaneously, and a filling system for filling bottles or similar containers 2 with a liquid, from a reservoir or bowl 6 that provides the liquid to be bottled, with control valves or liquid control valves 13, 14 and filling elements, the filling quantity of which is controlled by a control device 10, characterized in that the filling elements 3, 4 form at least one filling element group with at least two filling elements 3, 4, that each filling element group is associated with a flowmeter 9 for the measurement of the total quantity of liquid which is discharged in each filling phase via the filling elements 3, 4 of this filling element group, and that the control device 10 of the liquid control valves 13, 14 opens and/or closes the liquid control valves 13, 14 in a staggered manner, taking into consideration the measurement signal supplied by the respective flowmeter 9 and a time correction that compensates for the different flow rates of the filling elements 3, 4, and/or the at least one adjustable throttle 15 is influenced so that each container 2 contains the required or desired quantity of liquid after the completion of the filling phase.

One feature or aspect of an embodiment is believed at the time of the filing of this patent application to possibly reside broadly in a method for filling bottles or similar containers 2 with a liquid, from a reservoir or bowl 6 that provides the liquid to be bottled, using filling positions 3, 4, each of which has a control valve or liquid control valve 13, 14, wherein for at least two filling positions 3, 4 that form a filling position group the total quantity of liquid flowing into the containers 2 provided in these filling positions is measured with a flowmeter 9, and that the liquid control valves 13, 14 are opened and/or closed in a staggered manner taking into consideration the measurement signal supplied by the flowmeter 9 and a time correction that compensates for different filling rates of the filling positions 3, 4, so that each container 2 contains the required quantity of liquid following the completion of the filling phase.

Another feature or aspect of an embodiment is believed at the time of the filing of this patent application to possibly reside broadly in a method for filling bottles or similar containers 2 with a liquid, from a reservoir or bowl 6 that provides the liquid to be bottled, using filling positions 3, 4, each of which has a control valve or liquid control valve 13, 14, wherein for at least two filling positions 3, 4 that form a filling position group, the total quantity of liquid flowing into the containers 2 provided in these filling positions is measured with a flowmeter 9, and that the at least one adjustable throttle 15 is influenced, taking into consideration the measurement signal supplied by the flowmeter 9, so that each container 2 contains the required quantity of liquid following the completion of the filling phase, whereby the liquid control valves 13, 14 are opened and/or closed simultaneously or approximately simultaneously.

Yet another feature or aspect of an embodiment is believed at the time of the filing of this patent application to possibly reside broadly in the method, wherein the opening and/or closing of the liquid control valves 13, 14 of the filling positions 3, 4 of the filling position group taking into consideration the measurement signal supplied by the flowmeter 9 and the time correction that compensates for the different filling rates of the filling positions 3, 4, so that each container 2 contains the required quantity of liquid following the completion of the filling phase.

Still another feature or aspect of an embodiment is believed at the time of the filing of this patent application to possibly reside broadly in the method, wherein with at least two filling positions 3, 4 of the at least one filling position group located on different vertical levels, the time-corrected opening and/or closing of the liquid control valves 13, 14 occurs as a function of the difference in height between the level N of the liquid in the reservoir 6 and the level of the respective filling position 3, 4 or its discharge opening.

A further feature or aspect of an embodiment is believed at the time of the filing of this patent application to possibly reside broadly in the method, wherein the compensation for the different filling rates of the filling positions 3, 4 of the at least one group of filling positions is accomplished by throttling the delivery of liquid to the filling position 4 with the higher filling rate.

Another feature or aspect of an embodiment is believed at the time of the filing of this patent application to possibly reside broadly in the method, wherein the quantity of liquid and/or the fill level of the containers 2 which were filled in one and the same filling phase in the filling positions 3, 4 are determined, and any differences determined in the quantity and/or level are compensated by turning on the time corrections on the opening and/or closing of the liquid control valves 13, 14.

Yet another feature or aspect of an embodiment is believed at the time of the filing of this patent application to possibly reside broadly in a filling system for filling bottles or similar containers 2 with a liquid, from a reservoir or bowl 6 that provides the liquid to be bottled, with control valves or liquid control valves 13, 14 and filling elements, the filling quantity of which is controlled by a control device 10, wherein the filling elements 3, 4 form at least one filling element group with at least two filling elements 3, 4, that each filling element group is associated with a flowmeter 9 for the measurement of the total quantity of liquid which is discharged in each filling phase via the filling elements 3, 4 of this filling element group, and that the control device 10 of the liquid control valves 13, 14 opens and/or closes the liquid control valves 13, 14 in a staggered manner, taking into consideration the measurement signal supplied by the respective flowmeter 9 and a time correction that compensates for the different flow rates of the filling elements 3, 4, and/or the at least one adjustable throttle 15 is influenced so that each container 2 contains the required quantity of liquid after the completion of the filling phase.

Still another feature or aspect of an embodiment is believed at the time of the filing of this patent application to possibly reside broadly in the filling system, wherein an individual flowmeter 9 is associated with each filling element group.

A further feature or aspect of an embodiment is believed at the time of the filing of this patent application to possibly reside broadly in the filling system, wherein the control device 10 opens and/or closes the liquid control valves 13, 14 in a staggered manner taking into consideration the measurement signal supplied by the respective flowmeter 9 and a time correction that compensates for the different fill rates of the filling elements 3, 4.

Another feature or aspect of an embodiment is believed at the time of the filing of this patent application to possibly reside broadly in the filling system, wherein the at least one filling element group has at least two filling elements 3, 4 which are located at different heights.

Yet another feature or aspect of an embodiment is believed at the time of the filing of this patent application to possibly reside broadly in the filling system, wherein at least one throttle 15 is provided in a liquid line of the filling element 4 with the higher filling rate for the compensation of the different filling rates of the filling elements 3, 4 of the at least one filling element group.

Still another feature or aspect of an embodiment is believed at the time of the filing of this patent application to possibly reside broadly in the filling system, wherein means which determine the quantity of liquid and/or the fill height in the containers 2 which were filled in one and the same filling phase at the filling elements 3, 4 and thereby compensate for any differences measured in the quantity and/or fill level by activating time corrections on the opening and/or closing of the liquid control valves 13, 14.

A further feature or aspect of an embodiment is believed at the time of the filing of this patent application to possibly reside broadly in the filling system, wherein means which determine the quantity of liquid and/or the fill height in the containers 2 which were filled in one and the same filling phase at the filling elements 3, 4 and the same filling element group, and thereby compensate for any differences measured in the quantity and/or fill level by influencing the at least one adjustable throttle 15.

Another feature or aspect of an embodiment is believed at the time of the filing of this patent application to possibly reside broadly in the filling system, wherein it is a component of a filling machine with a plurality of filling element groups on a rotor 5 which can be driven in rotation around a machine axis VM.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

The following patents, patent applications, or patent publications are hereby incorporated by reference as if set forth in their entirety herein: WO 2006/011896, having the title "SYSTEM FOR SECURELY CONVEYING ARTICLES AND RELATED COMPONENTS," published on Feb. 2, 2006; U.S. Pat. No. 5,509,524, having the title "ARTICLE TRANSPORTATION PROCESSING SYSTEM," published on Apr. 23, 1996; U.S. Pat. No. 1,456,690, having the title "FILLING AND CAPPING MACHINE," published on May 29, 1923; and U.S. patent application Ser. No. 12/340,594, having the title "METHOD FOR HANDLING CONTAINERS AND CONTAINER HANDLING MACHINE," filed on Dec. 19, 2008.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; No. 5,056,511 issued to Ronge on Oct. 15, 1991; No. 5,273,082 issued to Paasche et al. on Dec. 28, 1993; and No. 5,301,488 issued to Ruhl et al. on Apr. 12, 1994.

Some examples of control systems which measure operating parameters and learn therefrom that may possibly be utilized or possibly adapted for use in at least one possible embodiment of the present application may possibly be found in the following U.S. Pat. No. 4,655,188 issued to Tomisawa et al. on Apr. 7, 1987; No. 5,191,272 issued to Torii et al. on Mar. 2, 1993; No. 5,223,820, issued to Sutterlin et al. on Jun. 29, 1993; and No. 5,770,934 issued to Theile on Jun. 23, 1998.

Some examples of cameras or the like optical monitoring apparatus that may possibly be utilized or possibly adapted for use in at least one possible embodiment of the present application may possibly be found in the following U.S. Pat. No. 5,233,186 issued to Ringlien on Aug. 3, 1993; No. 5,243,400 issued to Ringlien on Sep. 7, 1993; No. 5,369,713 issued to Schwartz et al. on Nov. 29, 1994; No. 5,442,446 issued to Gerber et al. on Aug. 15, 1995; No. 5,661,295 issued to Buchmann et al. on Aug. 26, 1997; and No. 5,898,169 issued to Nodbryhn on Apr. 27, 1999.

Some examples of timer apparatus that may possibly be utilized or possibly adapted for use in at least one possible embodiment of the present application may possibly be found in the following U.S. Pat. No. 5,910,739 issued to Stanojevic on Jun. 8, 1999; No. 5,999,087 issued to Gunton on Dec. 7, 1999; No. 6,016,531 issued to Rixner et al. on Jan. 18, 2000; No. 6,020,697 issued to Stenger et al. on Feb. 1, 2000; No. 6,020,775 issued to Chevallier on Feb. 1, 2000; and No. 6,038,197 issued to Phillips on Mar. 14, 2000.

Some examples of computer systems that may possibly be utilized or possibly adapted for use in at least one possible embodiment of the present application may possibly be found in the following U.S. Pat. No. 5,416,480 issued to Roach et al. on May 16, 1995; No. 5,479,355 issued to Hyduke on Dec. 26, 1995; No. 5,481,730 issued to Brown et al. on Jan. 2, 1996; No. 5,805,094 issued to Roach et al. on Sep. 8, 1998; No. 5,881,227 issued to Atkinson et al. on Mar. 9, 1999; and No. 6,072,462 issued to Moshovich on Jun. 6, 2000.

Some examples of control valve apparatus that may possibly be utilized or possibly adapted for use in at least one possible embodiment of the present application may possibly be found in the following U.S. Pat. No. 5,406,975 issued to Nakamichi et al. on Apr. 18, 1995; No. 5,503,184 issued to Reinartz et al. on Apr. 2, 1996; No. 5,706,849 issued to Uchida et al. on Jan. 13, 1998; No. 5,975,115 issued to Schwegler et al. on Nov. 2, 1999; No. 6,142,445 issued to Kawaguchi et al. on Nov. 7, 2000; and No. 6,145,538 issued to Park on No. 14, 2000.

Some examples of electric control valves that may possibly be utilized or possibly adapted for use in at least one possible embodiment of the present application may possibly be found in the following U.S. Pat. No. 4,431,160 issued to Burt et al. on Feb. 14, 1984; and No. 4,609,176 issued to Powers on Sep. 2, 1986.

Some examples of filling machines that utilize electronic control devices to control various portions of a filling or bottling process and that may possibly be utilized or possibly adapted for use in at least one possible embodiment of the present application may possibly be found in the following U.S. Pat. No. 4,821,921 issued to Cartwright et al. on Apr. 18, 1989; No. 5,056,511 issued to Ronge on Oct. 15, 1991; No. 5,273,082 issued to Paasche et al. on Dec. 28, 1993; and No. 5,301,488 issued to Ruhl et al. on Apr. 12, 1994.

Some examples of inductive flow meters, such as magnetic inductive flow meters, which may possibly be adapted for use in at least one possible embodiment, may possibly be found in the following: U.S. Pat. No. 5,808,208 entitled "Inductive flow meter;" U.S. Pat. No. 5,641,914 entitled "Inductive flow meter;" U.S. Pat. No. 5,121,640 entitled "Electromagnetic flow meter;" U.S. Pat. No. 4,972,722 entitled "Magnetic inductive flow meter;" and U.S. Pat. No. 4,522,073 entitled "Magnetic-inductive flow meter for high temperatures."

Some examples of methods for filling bottles using flow meters and/or arrangements for filling bottles comprising flow meters, which may possibly be adapted for use in at least one possible embodiment, may possibly be found in the following U.S. Patent Applications: No. 2009/0283177, having the title "METHOD AND DEVICE FOR THE CONTROLLED FOAMING OF A PRODUCT INTRODUCED IN BOTTLES OR SIMILAR CONTAINERS," published on Nov. 19, 2009; No. 2009/0236007, having the title "METHOD AND APPARATUS FOR FILLING BEVERAGE BOTTLES, IN A BEVERAGE BOTTLING PLANT, WITH A BEVERAGE MATERIAL COMPRISING A CARBONATED WATER COMPONENT AND A LIQUID FLAVORING COMPONENT, AND METHOD AND APPARATUS FOR FILLING CONTAINERS, IN A CONTAINER FILLING PLANT, WITH A MATERIAL COMPRISING A FIRST INGREDIENT AND A SECOND INGREDIENT," published on Sep. 24, 2009; No. 2009/0159150, having the title "METHOD OF OPERATING A BEVERAGE BOTTLING OR CONTAINER FILLING ARRANGEMENT WITH A FILLING VOLUME CORRECTING APPARATUS," published on Jun. 25, 2009; No. 2009/0095370, having the title "BEVERAGE BOTTLING PLANT HAVING A FILLING MACHINE WITH MULTIPLE BEVERAGE FILLING ELEMENTS, A FILLING MACHINE WITH MULTIPLE BEVERAGE FILLING ELEMENTS, A FILLING ELEMENT AND RELATED METHOD," published on Apr. 16, 2009; No. 2009/0071569, having the title "BEVERAGE BOTTLING PLANT FOR FILLING BOTTLES WITH A LIQUID BEVERAGE, HAVING A FLOW METER INTEGRATED INTO THE FILLING ELEMENT AND LOCATED IN THE FLOW PATH FOR FILLING BOTTLES WITH A LIQUID BEVERAGE AND A FILLING MACHINE HAVING SUCH A FILLING ELEMENT," published on Mar. 19, 2009; No. 2007/0204562, having the title "BEVERAGE BOTTLING PLANT FOR FILLING BOTTLES WITH A LIQUID BEVERAGE FILLING MATERIAL," published on Sep. 6, 2007.

All of the patents, patent applications or patent publications, which were cited in the International Search Report dated Sep. 19, 2008, and/or cited elsewhere are hereby incorporated by reference as if set forth in their entirety herein as follows: U.S. Pat. No. 6,378,575 B1, having the following title "Method for controlling the filling of containers with a flowable product and filling installation implementing said method," published on Apr. 30, 2002; and GB 2 288 168 A, having the following title "Master-slave filling valve system for bottling machine," published on Oct. 11, 1995.

The patents, patent applications, and patent publications listed above in the preceding paragraph are herein incorporated by reference as if set forth in their entirety except for the exceptions indicated below. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2007 030 559.3, filed on Jun. 30, 2007, having inventor Ludwig CLÜSSERATH, and DE-OS 10 2007 030 559.3 and DE-PS 10 2007 030 559.3, and International Application No. PCT/EP2008/004882, filed on Jun. 18, 2008, having WIPO Publication No. WO2009/003582 and inventor Ludwig CLÜSSERATH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent applications, that is, PCT/EP2008/004882 and Federal Republic of Germany Patent Application No. 10 2007 030 559.3, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2008/004882 and Federal Republic of Germany Patent Application No. 10 2007 030 559.3 from which this patent application claims priority which do not have to do with the correction of the translation in this patent application are not to be included in this patent application in the incorporation by reference.

Any statements about admissions of prior art in the original foreign patent applications PCT/EP2008/004882 and Federal Republic of Germany Patent Application No. 10 2007 030 559.3 are not to be included in this patent application in the incorporation by reference, since the laws relating to prior art in non-U.S. Patent Offices and courts may be substantially different from the Patent Laws of the United States.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Filling system
2 Bottle
3, 4 Filling element
5 Rotor
6 Bowl
6.1 Headspace
6.2 Liquid space
7 Distributor
8 Line
9 Flowmeter
10 Control device or computer
11, 12 Line
13, 14 Control or liquid control valve
15 Throttle
16, 17 Ring duct
18, 19 Line
VM Vertical machine axis
N Level of the liquid in bowl 6

What is claimed is:

1. A method for filling containers with liquid, said method comprising:

providing said liquid from a reservoir;

providing a filling position group comprising filling positions, at least two of which filling positions being configured to fill a container with said liquid at different, uncompensated filling rates;

measuring, with a common flow meter, a total volume of liquid flowing to said at least two filling positions during a filling phase;

opening and closing liquid control valves to dispense liquid into containers; and performing at least one of (a) and (b):

(a) operating said liquid control valves of said at least two filling positions at different times using a time correction based on a measurement signal provided by said flow meter, and (b) adjusting at least one throttle configured to influence the uncompensated filling rate of at least one of said at least two filling positions based on a measurement signal provided by said flow meter, and thereby compensating for said different, uncompensated filling rates, such that each of said containers contains a desired volume of said liquid at the end of said filling phase.

2. The method according to claim 1, wherein each of said at least two filling positions is located on a different vertical level.

3. The method according to claim 2, wherein:

said time correction is a function of a difference between a vertical level of said liquid in said reservoir and a vertical level of at least one of said at least two filling positions; and said measurement signal corresponds to said total volume of said liquid flowing to said at least two filling positions during said filling phase.

4. The method according to claim 3, wherein said step (a) of operating said liquid control valves comprises opening said liquid control valves at different times based upon said measurement signal and said time correction.

5. The method according to claim 3, wherein said step (a) of operating said liquid control valves comprises closing said liquid control valves at different times based upon said measurement signal and said time correction.

6. The method according to claim 3, wherein said step (a) of operating said liquid control valves comprises at least one of (c) and (d), where:

(c) opening said liquid control valves at different times based upon said measurement signal and said time correction; and (d) closing said liquid control valves at different times based on said measurement signal and said time correction.

7. The method according to claim 3, wherein said filling position group comprises a control device, said control device being configured to control opening and closing of said liquid control valves.

8. The method according to claim 1, wherein said time correction is a function of a difference between a vertical level of said liquid in said reservoir and a vertical level of at least one of said at least two filling positions.

9. The method according to claim 8, wherein said step (a) of operating said liquid control valves comprises at least one of (e) and (f):

(e) opening said liquid control valves at different times based upon said measurement signal and said time correction; and (f) closing said liquid control valves at different times based on said measurement signal and said time correction.

10. The method according to claim 1, wherein said step (b) of adjusting said at least one throttle comprises influencing the uncompensated filling rate of a vertically lower one of said at least two filling positions.

11. The method according to claim 10, wherein said method further comprises:

opening said liquid control valves of said at least two filling positions essentially simultaneously; and closing said liquid control valves of said at least two filling positions essentially simultaneously.

12. The method according to claim 1, wherein:

said at least two filling positions comprise:

a first filling position located at a first vertical level and comprising a first uncompensated filling rate;

a second filling position located at a second vertical level and comprising a second uncompensated filling rate; and said first vertical level being greater in height than said second vertical level;

said time correction is a function of a difference between said first vertical level and said second vertical level;

said measurement signal corresponds to said total volume of said liquid flowing into said at least two filling positions during said filling phase; and said step (a) of operating said liquid control valves comprises at least one of (g) and (h):

(g) opening said liquid control valves of said first filling position and said second filling position at different times based upon said measurement signal and said time correction; and (h) closing said liquid control valves of said first filling position and said second filling position at different times based on said measurement signal and said time correction.

13. The method according to claim 1, wherein:

said at least two filling positions comprise:

a first filling position located at a first vertical level and comprising a first uncompensated filling rate;

a second filling position located at a second vertical level and comprising a second uncompensated filling rate; and said first vertical level being greater in height than said second vertical level;

said at least one throttle influences said second uncompensated filling rate so as to be essentially equal to said first uncompensated filling rate;

said measurement signal corresponds to said total volume of said liquid flowing into said at least two filling positions during said filling phase; and said method further comprises (i) and (j):

(i) opening said liquid control valves of said first filling position and said second filling position essentially simultaneously; and (j) closing said liquid control valves of said first filling position and said second filling position essentially simultaneously.

14. A filling system for filling containers with liquid, said system comprising:

a reservoir configured to hold a volume of liquid;

at least one filling element group comprising filling elements, at least two of which filling elements being configured to fill containers with liquid at different, uncompensated filling rates;

a liquid control valve being associated with each of said filling elements of said filling element group;

a common flow meter configured to measure a total volume of liquid flowing to said at least two filling elements during a filling phase;

a control device configured to open and close said liquid control valves to dispense liquid into containers; and wherein at least one of (k) and (l):

(k) said control device is configured to operate said liquid control valves of said at least two filling elements at different times using a time correction based on a measurement signal provided by said flow meter, and (l) said control device is configured to adjust at least one throttle configured to influence the uncompensated filling rate of at least one of said at least two filling elements based on a measurement signal provided by said flow meter, to thereby compensate for said different, uncompensated filling rates, such that containers filled by said at least two filling elements contain a desired volume of said liquid at the end of a filling phase.

15. The system according to claim 14, wherein each of said at least two filling elements is located on a different vertical level.

16. The system according to claim 15, wherein:

said time correction is a function of a difference between a vertical level of said liquid in said reservoir and a vertical level of at least one of said at least two filling elements; and said measurement signal corresponds to said total volume of said liquid flowing to said at least two filling elements during said filling phase.

17. The system according to claim 16, wherein said control device is configured to at least one of:

open said liquid control valves of said at least two filling elements at different times based on said measurement signal and said time correction; and close said liquid control valves of said at least two filling elements at different times based on said measurement signal and said time correction.

18. The system according to claim 16, wherein:

a plurality of filling element groups form a filling machine;

each of said plurality of filling element groups is disposed on a rotor driven in rotation around a machine axis; and each of said filling element groups comprises a flow meter.

19. The system according to claim 15, wherein said at least one throttle is configured to influence the uncompensated filling rate of a vertically lower one of said at least two filling elements.

20. The system according to claim 19, wherein said control device is configured to:

open said liquid control valves of said at least two filling elements essentially simultaneously; and close said liquid control valves of said at least two filling elements essentially simultaneously.

* * * * *